US006454453B1

(12) United States Patent
Ambrosio

(10) Patent No.: US 6,454,453 B1
(45) Date of Patent: Sep. 24, 2002

(54) HAND TOOL FOR DRIVING, AND SELECTIVELY ILLUMINATING THROUGH, A CONVENTIONAL SOCKET

(76) Inventor: Donato Ambrosio, 18 Emily Dr., Centereach, NY (US) 11720

( * ) Notice: Subject to any disclaimer, the term of this patent is extended or adjusted under 35 U.S.C. 154(b) by 11 days.

(21) Appl. No.: 09/733,746

(22) Filed: Dec. 8, 2000

(51) Int. Cl.[7] ..... F21L 7/00

(52) U.S. Cl. ..... 362/577; 362/120; 362/119; 362/578

(58) Field of Search ..... 362/119, 577, 362/120, 109, 578; 385/54, 55, 72, 147

(56) References Cited

U.S. PATENT DOCUMENTS

| | | | | |
|---|---|---|---|---|
| 5,510,962 A | | 4/1996 | Hsiao | 362/120 |
| 5,579,668 A | | 12/1996 | Kozak | 81/439 |
| 5,819,612 A | | 10/1998 | Anderson | 81/490 |
| 5,921,673 A | * | 7/1999 | Habel et al. | 362/577 |
| 6,158,873 A | * | 12/2000 | Griffiths | 362/158 |
| 6,283,607 B1 | * | 9/2001 | Lin | 362/119 |

* cited by examiner

*Primary Examiner*—Sandra O'Shea
*Assistant Examiner*—Anabel Ton

(74) *Attorney, Agent, or Firm*—Richard L. Miller

(57) ABSTRACT

A hand tool that drives, and selectively illuminates through, a conventional socket, and which includes a handle, a shaft, a tip, and illuminating apparatus. The handle has a throughbore. The shaft is fixedly received in the handle and has a throughbore that communicates with the throughbore in the handle. The tip extends from the shaft and engages in the conventional socket and has a throughbore that communicates with the throughbore in the shaft. The illuminating apparatus includes a fiber optic strand, a module, and a light. The fiber optic strand extends in the throughbores in the handle, the shaft, and the tip. The module is replaceably attached to the handle and includes a case and a dial switch. The case holds a battery, contains a battery interface, and has a throughbore and a collar that threadably engages in the handle. The collar has a throughbore that communicates with the throughbore in the case and the throughbore in the handle. The light sits in the throughbore in the case, electrically communicates with the battery interface, and illuminates through the throughbore in the collar and through the fiber optic strand so as to illuminate through the conventional socket. The dial switch is rotatably mounted to the case and electrically communicates with the battery interface so as to selectively illuminate the light when rotated accordingly.

3 Claims, 1 Drawing Sheet

FIG. 1
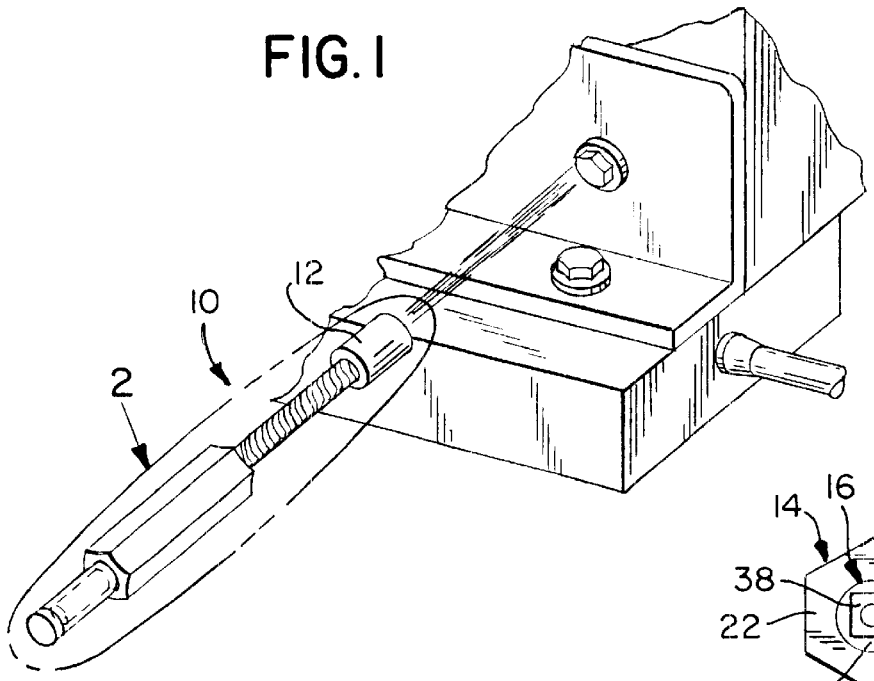
FIG. 4
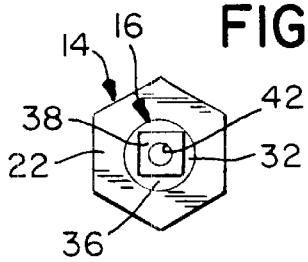
FIG. 2
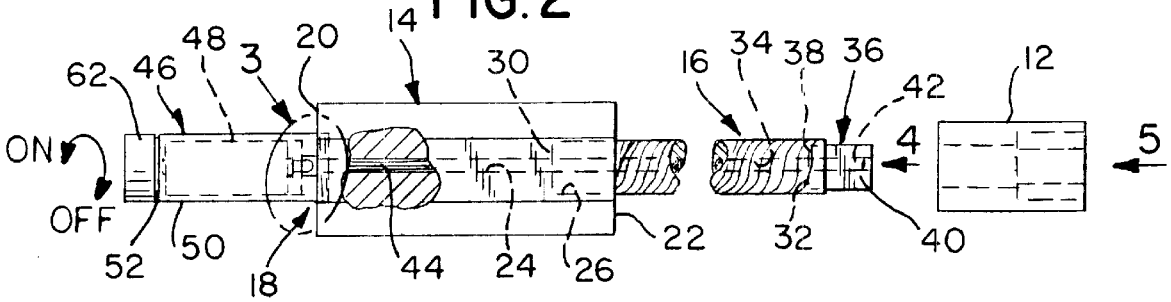
FIG. 3
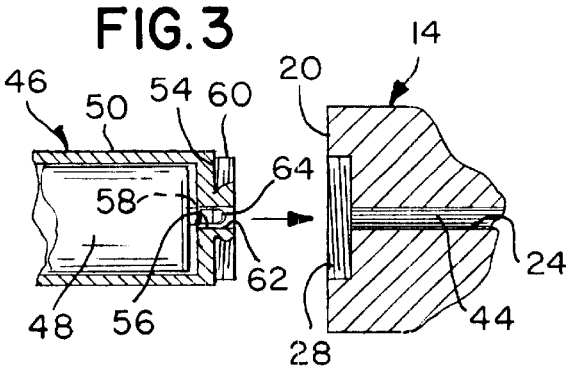
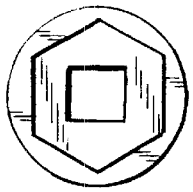
FIG. 5

HAND TOOL FOR DRIVING, AND SELECTIVELY ILLUMINATING THROUGH, A CONVENTIONAL SOCKET

BACKGROUND OF THE INVENTION

1. Field of the Invention

The present invention relates to a hand tool. More particularly, the present invention relates to a hand tool for driving, and selectively illuminating through, a conventional socket.

2. Description of the Prior Art

Numerous innovations for screwdrivers have been provided in the prior art that will be described. Even though these innovations may be suitable for the specific individual purposes to which they address, however, they differ from the present invention.

A FIRST EXAMPLE, U.S. Pat. No. 5,510,962 to Hsiao teaches a screwdriver having a lamp holder mounted at one end of the handle around the driving shank, and a lamp and battery assembly mounted within a recessed hole on the lamp holder, wherein the lamp is turned on to give off light when the lamp and battery assembly is depressed, or turned off when the lamp and battery assembly is released from the hand.

A SECOND EXAMPLE, U.S. Pat. No. 5,579,668 to Kozak teaches a multi-function screwdriver that has a handle with first and second ends that support a pair of removable and reversible screwdriver tips therein. The handle has first and second axial bores in each of the ends with the second bores of a greater diameter but lesser depth than the corresponding ones of the first bores. The second bores in the handle each have a bushing disposed therein which is suitable sized and configured for axial and radial retention. The removable and reversible screwdriver tips are each operatively associated with one of the first and second ends of the handle. The screwdriver tips each have an elongated shank of non-circular cross-section and a driving tip on each of opposite ends thereof. The bushings also each have an inner surface of non-circular cross-section for receiving at least one of the screwdriver tips therein. With this arrangement, the bushings are sized and shaped to transmit torque applied to the handle to fasteners through the elongated shanks and the driving tips of the removable and reversible screwdriver tips.

A THIRD EXAMPLE, U.S. Pat. No. 5,819,612 to Anderson teaches an ergonomic, improved multiple bit storing hand tool that provides storage capacity for a large number of bits while minimizing bulk material volume and hand gripping member cross sectional area so as to provide for increased gripping ability. The improved multiple bit storing hand tool includes a non-cylindrical, elongated, hand gripping portion having corners and a central axis substantially parallel to a plurality of substantially parallel corner axes of the corners. In a variant, the corner axes are generally lobular and include epicycloidal portions thereof. Each of the substantially parallel corner axes are substantially equidistant from the central axis and substantially equidistant one from another. A plurality of elongated storage compartments having compartment axes are substantially parallel to the parallel corner axes and the central axis. A plurality of the elongated storage compartment axes are substantially disposed at a point on an imaginary line connecting the central axis and each of the parallel corner axes. The number of bits stored within the multiple bit storing hand tool is maximized while the elongated hand gripping portion of the hand tool is minimized in bulk volume and weight as compared to a conventional tool having a cylindrical hand gripping portion.

It is apparent that numerous innovations for screwdrivers have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a hand tool for driving, and selectively illuminating through, a conventional socket that avoids the disadvantages of the prior art.

ANOTHER OBJECT of the present invention is to provide a hand tool for driving, and selectively illuminating through, a conventional socket that is simple and inexpensive to manufacture.

STILL ANOTHER OBJECT of the present invention is to provide a hand tool for driving, and selectively illuminating through, a conventional socket that is simple to use.

BRIEFLY STATED, STILL YET ANOTHER OBJECT of the present invention is to provide a hand tool that drives, and selectively illuminates through, a conventional socket, and which includes a handle, a shaft, a tip, and illuminating apparatus. The handle has a throughbore. The shaft is fixedly received in the handle and has a throughbore that communicates with the throughbore in the handle. The tip extends from the shaft and engages in the conventional socket and has a throughbore that communicates with the throughbore in the shaft. The illuminating apparatus includes a fiber optic strand, a module, and a light. The fiber optic strand extends in the throughbores in the handle, the shaft, and the tip. The module is replaceably attached to the handle and includes a case and a dial switch. The case holds a battery, contains a battery interface, and has a throughbore and a collar that threadably engages in the handle. The collar has a throughbore that communicates with the throughbore in the case and the throughbore in the handle. The light sits in the throughbore in the case, electrically communicates with the battery interface, and illuminates through the throughbore in the collar and through the fiber optic strand so as to illuminate through the conventional socket. The dial switch is rotatably mounted to the case and electrically communicates with the battery interface so as to selectively illuminate the light when rotated accordingly.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 a diagrammatic perspective view of the present invention in use;

FIG. 2 is an enlarged exploded diagrammatic side elevational view of the area generally enclosed by the dotted curve identified by arrow 2 in FIG. 1 of the present invention cooperating with a conventional socket;

FIG. 3 is an enlarged diagrammatic cross sectional view of the area generally enclosed in the dotted curve identified by arrow 3 in FIG. 2 of the power connection of the present invention;

FIG. 4 is an enlarged diagrammatic end view taken generally in the direction of arrow 4 in FIG. 2 of the socket interface of the present invention; and FIG. 5 is an enlarged diagrammatic end view taken generally in the direction of arrow 5 in FIG. 2 of a prior art conventional socket to be utilized with, but is not a part of, the present invention.

LIST OF REFERENCE NUMERALS UTILIZED IN THE DRAWING

10 hand tool of present invention for driving, and selectively illuminating through, conventional socket 12
12 conventional socket
14 handle
16 shaft
18 illuminating apparatus
20 rearwardmost end of handle 14
22 forwardmost end of handle 14
24 throughbore extending longitudinally and centrally through handle 14
26 blindbore in forwardmost end 22 of handle 14
28 blindbore in rearwardmost end 20 of handle 14
30 rearwardmost end of shaft 16
32 forwardmost end of shaft 16
34 throughbore extending longitudinally and centrally through shaft 16
36 tip for engaging in, rotating with, and driving, socket 12
38 shaft-abutting end of tip 36
40 free end of tip 36
42 throughbore extending longitudinally and centrally through tip 36
44 fiber optic strand of illuminating apparatus 18
46 module of illuminating apparatus 18 for holding battery 48
48 battery
50 case of module 46 of illuminating apparatus 18 for holding battery 48
52 rearwardmost end of case 50 of module 46 of illuminating apparatus 18
54 forwardmost end of case 50 of module 46 of illuminating apparatus 18
56 throughbore through forwardmost end 54 of case 50 of module 46 of illuminating apparatus 18
58 battery interface contained in case 50 of module 46 of illuminating apparatus 18 for electrically communicating with battery 48 contained therein
60 collar of case 50 of module 46 of illuminating apparatus 18
62 throughbore through collar 60 of case 50 of module 46 of illuminating apparatus 18
64 light of module 46 of illuminating apparatus 18 for illuminating through conventional socket 12
66 dial switch of module 46 of illuminating apparatus 18

DETAILED DESCRIPTION OF THE PREFERRED EMBODIMENT

Referring now to the figures, in which like numerals indicate like parts, and particularly to FIG. 1, the hand tool of the present invention is shown generally at 10 for driving, and selectively illuminating through, a conventional socket 12.

The general configuration of the hand tool 10 can best be seen in FIGS. 2–4, and as such, will be discussed with reference thereto.

The hand tool 10 comprises a handle 14, a shaft 16 that extends coaxially from the handle 14 for engaging the conventional socket 12, and illuminating apparatus 18 that is operatively connected to the handle 14.

The handle 14 is slender, elongated, and has an hexagonal lateral cross section for facilitating gripping thereof, a rearwardmost end 20, and a forwardmost end 22.

The handle 14 further has a throughbore 24 that extends longitudinally and centrally therethrough, from, and opens into, the rearwardmost end 20 thereof, to, and opens into, the forwardmost end 22 thereof.

The forwardmost end 22 of the handle 14 has a blindbore 26 that extends longitudinally and centrally therein, and communicates with, and is coaxial with, but has a diameter greater than that of, the throughbore 24 in the handle 14.

The rearwardmost end 20 of the handle 14 has a blindbore 28 that extends longitudinally and centrally therein, is threaded, and communicates with, and is coaxial with, but has a diameter greater than that of, the throughbore 24 in the handle 14.

The shaft 16 is slender, elongated, flexible, and has a rearwardmost end 30 that is fixedly received in, and has a diameter as that of, the blindbore 26 in the forwardmost end 22 of the handle 14 for rotation therewith, and a forwardmost end 32.

The shaft 16 further has a throughbore 34 that extends longitudinally and centrally therethrough, from, and opens into, the rearwardmost end 30 thereof, to, and opens into, the forwardmost end 32 thereof, and communicates with, is collinear with, and has a diameter as that of, the throughbore 24 in the handle 14.

The hand tool 10 further comprises a tip 36 that is square in lateral cross section for replaceably engaging in, rotating with, and driving, the conventional socket 12, and has a rearwardmost end 38 that is coincident with, and extends coaxially from, the forwardmost end 32 of the shaft 16 for rotation therewith, and a forwardmost end 40.

The tip 36 further has a throughbore 42 that extends longitudinally and centrally therethrough, from, and opens into, the rearwardmost end 38 thereof, to, and opens into, the forwardmost end 40 thereof, and communicates with, is collinear with, and has a diameter as that of, the throughbore 34 in the shaft 16.

The illuminating apparatus 18 comprises a fiber optic strand 44 that extends coaxially and continuously in the throughbore 24 in the handle 14, the throughbore 34 in the shaft 16, and the throughbore 42 in the tip 36, from, but not entering into, the blindbore 28 in the rearwardmost end 20 of the handle, to the forwardmost end 40 of the tip 36.

The illuminating apparatus 18 further comprises a module 46 that is replaceably attached to the handle 14 for holding a battery 48.

The module 46 comprises a case 50 that is slender, elongated, cylindrically-shaped for holding the battery 48, and has a rearwardmost end 52, and a forwardmost end 54 that has a diameter less than that of the handle 14 so as to avoid being gripped when the handle 14 is gripped so as to be prevented from being broken off when attached to the handle 14.

The forwardmost end 54 of the case 50 has a throughbore 56 that extends longitudinally and centrally therethrough.

The case 50 contains a battery interface 58 for electrically communicating with the battery 48 contained therein.

The case 50 further has a collar 60 that extends coaxially from, and has a diameter less than that of, the forwardmost end 54 of the case 50, and is threaded so as to threadably engage in, and have a diameter as that the blindbore 28 in the rearwardmost end 20 of the handle 14 so as to attach the module 46 to the handle 14.

The collar 60 of the case 50 has a throughbore 62 that extends longitudinally and centrally therethrough, and communicates with, and is collinear with, the throughbore 56 in the forwardmost end 54 of the case 50 and communicates with, and has a diameter as that of, the throughbore 24 in the handle 14.

The module 46 further comprises a light 64 that sits in the throughbore 56 in the forwardmost end 54 of the case 50, electrically communicates with the battery interface 58 in the case 50 for powering thereby, and illuminates through the throughbore 62 in the collar 60 of the case 50 and through the fiber optic strand 44 for illuminating through the conventional socket 12.

The light 64 is a bulb.

The light 64 is an LED.

The module 46 further comprises a dial switch 66 that is disk-shaped, rotatably mounted to, is coaxial with, and has a diameter as that of, the rearwardmost end 52 of the case 46, and electrically communicates with the battery interface 58 so as to selectively illuminate the light 64 when rotated accordingly.

It will be understood that each of the elements described above, or two or more together, may also find a useful application in other types of constructions differing from the types described above.

While the invention has been illustrated and described as embodied in a hand tool for driving and selectively illuminating through, a conventional socket, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A hand tool for driving, and selectively illuminating through, a conventional socket, comprising:

a) a handle;

b) a shaft extending coaxially from said handle for engaging the conventional socket;

c) illuminating apparatus operatively connected to said handle; and;

d) a tip being square in lateral cross section for replaceably engaging in, rotating with, and driving, the conventional socket;

wherein said handle is slender, elongated, and has:

i) an hexagonal lateral cross section for facilitating gripping thereof;

ii) a rearwardmost end;

iii) a forwardmost end; and iv) a throughbore that extends longitudinally and centrally therethrough, from, and opens into, said rearwardmost end thereof, to, and opens into, said forwardmost end thereof;

wherein said forwardmost end of said handle has a blindbore that extends longitudinally and centrally therein, and communicates with, and is coaxial with, but has a diameter greater than that of, said throughbore in said handle;

wherein said rearwardmost end of said handle has a blindbore that extends longitudinally and centrally therein, is threaded, and communicates with, and is coaxial with, but has a diameter greater than that of, said throughbore in said handle;

wherein said shaft is slender, elongated, flexible, and has:

i) a rearwardmost end that is fixedly received in, and has a diameter as that of, said blindbore in said forwardmost end of said handle for rotation therewith;

ii) a forwardmost end; and ii) a throughbore that extends longitudinally and centrally therethrough, from, and opens into, said rearwardmost end thereof, to, and opens into, said forwardmost end thereof, and communicates with, is collinear with, and has a diameter as that of, said throughbore in said handle;

wherein said tip has:

i) a rearwardmost end being coincident with, and extending coaxially from, said forwardmost end of said shaft for rotation therewith;

ii) a forwardmost end; and iii) a throughbore that extends longitudinally and centrally therethrough, from, and opens into, said rearwardmost end thereof, to, and opens into, said forwardmost end thereof, and communicates with, is collinear with, and has a diameter as that of, said throughbore in said shaft;

wherein said illuminating apparatus comprises:

i) a fiber optic strand that extends coaxially and continuously in said throughbore in said handle, said throughbore in said shaft, and said throughbore in said tip, from, but not entering into, said blindbore in said rearwardmost end of said handle, to said forwardmost end of said tip; and ii) a module that is replaceably attached to said handle for holding a battery;

wherein said module comprises a case that is slender, elongated, cylindrically-shaped for holding the battery, and has:

i) a rearwardmost end; and ii) a forwardmost end that has a diameter less than that of said handle so as to avoid being gripped when said handle is gripped so as to be prevented from being broken off when attached to said handle;

wherein said forwardmost end of said case has a throughbore that extends longitudinally and centrally therethrough;

wherein said case contains a battery interface for electrically communicating with the battery contained therein;

wherein said case further has a collar that extends coaxially from, and has a diameter less than that of, said forwardmost end of said case, and is threaded so as to threadably engage in, and have a diameter as that of, said blindbore in said rearwardmost end of said handle so as to attach said module to said handle;

wherein said collar of said case has a throughbore that extends longitudinally and centrally therethrough, and communicates with, and is collinear with, said throughbore in said forwardmost end of said case and communicates with, and has a diameter as that of, said throughbore in said handle; and wherein said module further comprises:

i) a light that sits in said throughbore in said forwardmost end of said case, electrically communicates with said battery interface in said case for powering thereby, and illuminates through said throughbore in said collar of said case and through said fiber optic strand for illuminating through the conventional socket; and ii) a dial switch that is disk-shaped, rotatably mounted to, is coaxial with, and has a diameter as that of, said rearwardmost end of said case, and electrically communicates with said battery interface so as to selectively illuminate said light when rotated accordingly.

2. The tool as defined in claim 1, wherein said light is a bulb.

3. The tool as defined in claim 1, wherein said light is an LED.

* * * * *